United States Patent [19]

Grieco et al.

[11] Patent Number: 5,004,992

[45] Date of Patent: Apr. 2, 1991

[54] MULTI-RESONATOR CERAMIC FILTER AND METHOD FOR TUNING AND ADJUSTING THE RESONATORS THEREOF

[75] Inventors: Steven E. Grieco; Douglas A. Morris, both of Albuquerque, N. Mex.

[73] Assignee: Motorola, Inc., Schaumburg, Ill.

[21] Appl. No.: 529,098

[22] Filed: May 25, 1990

[51] Int. Cl.[5] ..... H01P 1/202

[52] U.S. Cl. ..... 333/202; 333/207; 333/223; 333/134

[58] Field of Search ..... 333/202, 206, 207, 203, 333/222, 223, 235, 134; 29/600; 455/7, 8, 83

[56] References Cited

U.S. PATENT DOCUMENTS

| | | | |
|---|---|---|---|
| 4,806,889 | 2/1989 | Nakano et al. | 333/206 X |
| 4,823,098 | 4/1989 | De Muro et al. | 333/206 |
| 4,855,693 | 8/1989 | Matsukura et al. | 333/207 X |
| 4,965,537 | 10/1990 | Kommrusch | 333/202 |

*Primary Examiner*—Eugene R. LaRoche

*Assistant Examiner*—Seung Ham

*Attorney, Agent, or Firm*—Rolland R. Hackbart

[57] ABSTRACT

A ceramic block filter (114,118) employs a novel tuning process which avoids the necessity of etching or abrading plating on the top surface of the block. Initially, the blocks (210) are prepared from a batch of ceramic material such that their height is intentionally longer than desired, so that the filter center frequency is slightly lower than desired. Next, an artwork mask (310) designed in accordance with pre-selected frequency related characteristics and desired performance specifications is used for applying an electrically conductive material (240) to the top surface of the block (210). Then, the center frequency and resonator length of the block (210) are measured and a new resonator length is calculated using the measured values. The bottom surface of the block (210) is next lapped to the new resonator length. Then, electrically conductive material is applied to the lapped bottom surface of the block (210).

8 Claims, 2 Drawing Sheets

310

MULTI-RESONATOR CERAMIC FILTER AND METHOD FOR TUNING AND ADJUSTING THE RESONATORS THEREOF

BACKGROUND OF THE INVENTION

The present invention relates generally to radio-frequency (RF) signal filters, and, more particularly, to multi-resonator ceramic filters and mask tuning and adjusting the resonators thereof.

Conventional multi-resonator ceramic filters typically include a plurality of resonators such as foreshortened short-circuited quarter wavelength coaxial or helical transmission lines. The resonators are arranged in a conductive enclosure and may be coupled one to another by apertures in their common walls. Each resonator is commonly tuned to the desired response characteristics in one of two ways.

One way of tuning such resonators is by employing a tuning screw which inserts into a hole extending through the middles of the resonator (see U.S. Pat. No. 3,728,731). Unfortunately, the tuning screw is bulky, it requires mechanical locking elements which may offset the desired coupling between resonators, and, due to the adjustability of the screw before it is locked, it renders these filters susceptible to becoming detuned.

Another way of tuning each resonator is by plating one surface of the ceramic filter at each resonator with conductive plating material (see U.S. Pat. Nos. 4,431,977 and 4,742,562). Typically, the surface is plated between the hole in the middle of the resonator and a side wall coupled to the conductive enclosures. This plating is then abraded away for each resonator in the filter until the desired response characteristics are obtained. This approach is undesirable in that it is extremely labor intensive and therefor costly. Plating at each resonator must be repeatedly abraded followed by testing for the desired response characteristics. If too much plating is removed, the filter must be replated, backtuned, or discarded.

For these reasons, there is a need for an improved ceramic filter tuning technique which overcomes the foregoing deficiencies.

OBJECT OF THE INVENTION

Accordingly, it is an object of the present invention to provide a multi-resonator ceramic filter wherein the resonators are tuned and thereafter adjusted in length to provide desired frequency related characteristics.

DETAILED DESCRIPTION OF THE PREFERRED EMBODIMENT

The filters implemented according to the present invention have particular use for filtering signals in a radio frequency (RF) communication system. More particularly, the present invention is directed to the manufacture and tuning of ceramic filters, including their implementation as a duplexer in radio transceivers.

Figure 1:
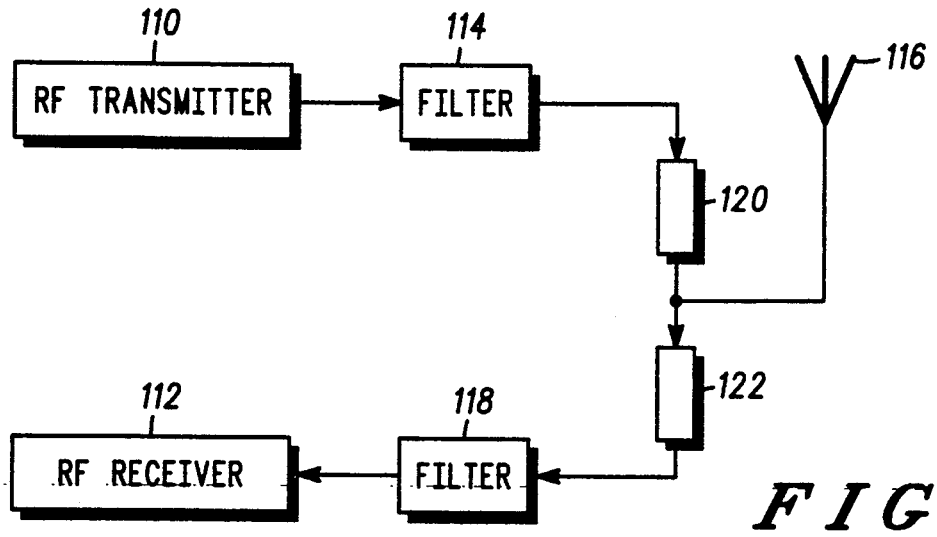
FIG. 1 is a diagram of a RF radio transceiver employing two filters, according to the present invention.

FIG. 1 illustrates a radio transceiver that may advantageously utilize filters of the present invention. The transceiver includes a conventional RF transmitter 110, and a conventional RF receiver 112. A novel ceramic filter 114, according to the present invention, may be used to couple a transmit RF signal from the RF transmitter 110 to an antenna 116. A similar novel ceramic filter 118 may be employed between the antenna 116 and the RF receiver 112 to couple a received RF signal from the antenna 116 to the RF receiver 112. Together, the filters 114 and 118 function as a duplexer to intercouple the antenna 116 to the transceiver. Transmission lines 120 and 122 are respectively disposed between the ceramic filters 114 and 118 and the antenna 116 for proper electrical coupling. Alternatively, the filters 114 and 118 with elements 120 and 122 may be combined onto a single dielectric block, as illustrated in U.S. Pat. No. 4,742,562, incorporated herein by reference.

The passband of filter 114 is a centered about the frequency of the transmit RF signal from RF transmitter 110, while at the same time greatly attenuating the frequency of the received RF signal. In addition, the length of transmission line 120 may be selected to maximize its impedance at the frequency of the received signal. The passband of filter 118 is centered about the frequency of the received RF signal, while at the same time greatly attenuating the transmit signal. The length of transmission line 122 may also be selected to maximize its impedance at the transmit RF signal frequency.

Figure 2:
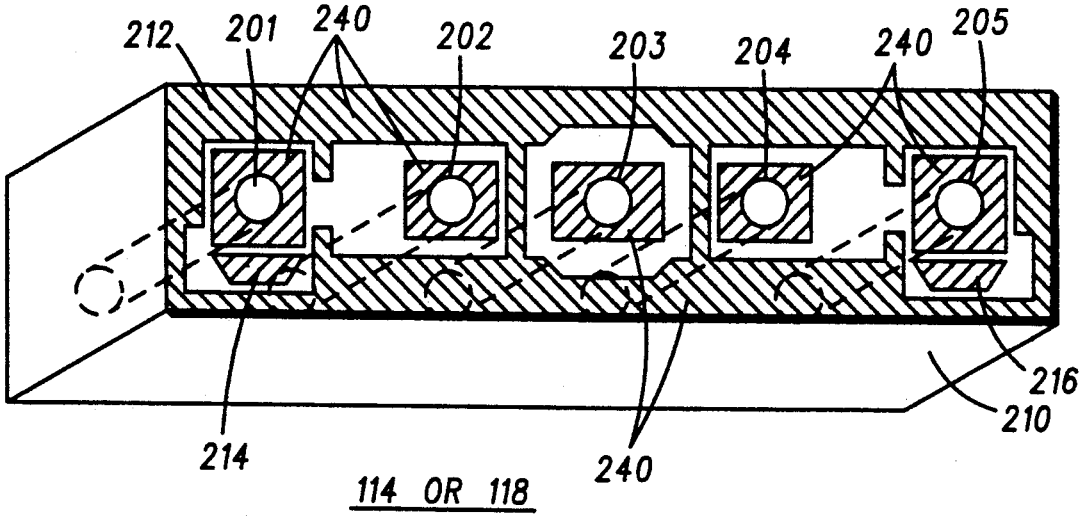
FIG. 2 is an expanded diagram of one of the filters 114 or 118 in FIG. 1, according to the present invention.
Figure 3:
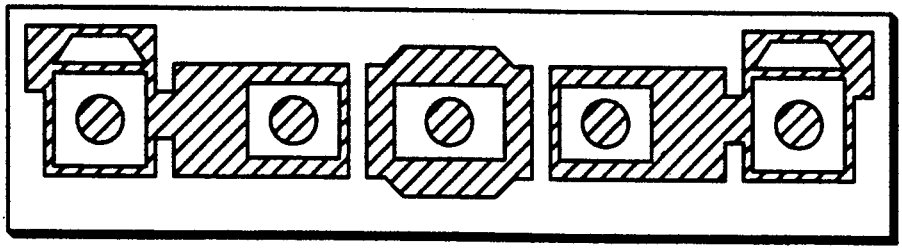
FIG. 3 is a diagram of an artwork mask for the filters 114 or 118 in FIG. 2, according to the present invention.

In FIG. 2, filter 114 or 118 is shown in detail, according to the present invention. Filter 114 or 118 includes base dielectric block 210 which is comprised of a ceramic material that is selectively plated with a conductive material. Block 210 may include input and output electrodes 214 and 216 plated thereon for receiving an input RF signal and for passing a filtered RF signal, respectively. RF signals may be coupled to electrodes 214 and 216 of the filter 114 or 118 by conventional circuits such as those discussed in U.S. Pat. No. 4,431,977, incorporated herein by reference. In other embodiments, coupling pins and plugs may be inserted into resonators 201 and 202 for coupling RF signals thereto, instead of electrodes 214 and 216.

The plating on block 210 is electrically conductive material, preferably copper, silver or an alloy thereof. Such plating substantially covers all surfaces of the block 210 with the exception of top surface 212, the plating of which is applied as described hereinbelow. Of course, other conductive plating arrangements may be utilized in practicing the present invention (see, for example, those shown in U.S. Pat. Nos. 4,431,977 and 4,692,726).

Block 210 includes five holes 201–205, each of which extends from the top surface to the bottom surface thereof. The surfaces defining holes 201–205 are likewise plated with electrically conductive material. Each of the plated holes 201–205 is essentially a transmission line resonator comprised of a short-circuited coaxial transmission line having a length selected for desired filter response characteristics. Although block 210 is shown with five plated holes 201–205, any number of plated holes may be utilized depending on the filter response characteristics desired. For additional description of the holes 201–205, reference may be made to U.S. Pat. Nos. 4,431,977 and 4,742,562.

Coupling between the transmission line resonators, provided by the plated holes 201-205 in FIG. 2 is primarily accomplished through the dielectric material and is coarsely adjusted by varying the effective width of the dielectric material and the distance between adjacent transmission line resonators. In other embodiments, coupling between resonators 201-205 may also be achieved and adjusted by the arrangement of the electrically conductive material on top surface 212. The effective width of the dielectric material between adjacent holes 201-205 may be adjusted in any suitable regular or irregular manner; for example, by the use of slots, cylindrical holes, square or rectangular holes, or irregular shaped holes, which may also be partially or entirely plated with electrically conductive material. Fine coupling and frequency adjustments may be made according to the predesigned artwork mask 301 as described in further detail hereinbelow.

According to the present invention, top surface 212 of block 210 is selectively plated according to predesigned artwork mask 301 with electrically conductive material 240, indicated by shaded areas in FIG. 2. The unplated areas of top surface 212 are indicated by the unshaded areas in FIG. 2. The artwork mask design may be based upon selected frequency related characteristics of the base dielectric block 210 and other design specifications for a particular filter. Use of the term "base dielectric block" when referring to block 210 in FIG. 2 means that it is in a basic form with no plating on top surface 212. The selected frequency related characteristics may include the quarter wave length frequency, the height, and/or the dielectric constant of base dielectric block 210.

Base dielectric block 210 may be constructed of any suitable dielectric material that has low loss, a high dielectric constant and a low temperature coefficient of the dielectric constant. For example, base dielectric block 210 may be comprised of a number of different suitable ceramic compounds, one of which includes barium oxide, titanium oxide and zirconium oxide, the electrical characteristics of which are described in more detail in an article by G. H. Jonker and W. Kwestroo, entitled "The Ternary Systems $BzO-TiO_2-SnO_2$ and $BaO-TiO_2-ZrO_2$", published in the Journal of the American Ceramic Society, volume 41, number 10, at pages 390-394, October 1958. Of the ceramic compounds described in this article, the compound in Table VI having the composition 18.5 mole % BaO, 77.0 mole % $TiO_2$ and 4.5 mole % $ZrO_2$ and having a dielectric constant of 40 is suitable for use in the ceramic filter of the present invention.

The ceramic material for base dielectric block 210 is may be prepared in a batch of material, useful for developing a large number of base dielectric blocks 210. One batch of such ceramic material, when appropriately used, will result in similar frequency related characteristics throughout base dielectric blocks 210 produced thereform. Although produced from the same batch, base dielectric blocks 210 may vary slightly from one to another causing corresponding variations in the center frequency of the passband response therefor. For example, the dielectric constant Er may vary up to 0.6 from block to block resulting in a center frequency variation that may exceed 7 MHz. In practical applications, the center frequency of base dielectric blocks 210 must be held to within a maximum of 2 MHz to 4 MHz depending on the performance specifications to be met. By utilizing the present invention, base dielectric blocks 210 may be processed into filters 114 or 118 having resonators which are tuned according to a predesigned artwork mask and thereafter adjusted in length to meet desired performance specifications.

Figure 4:
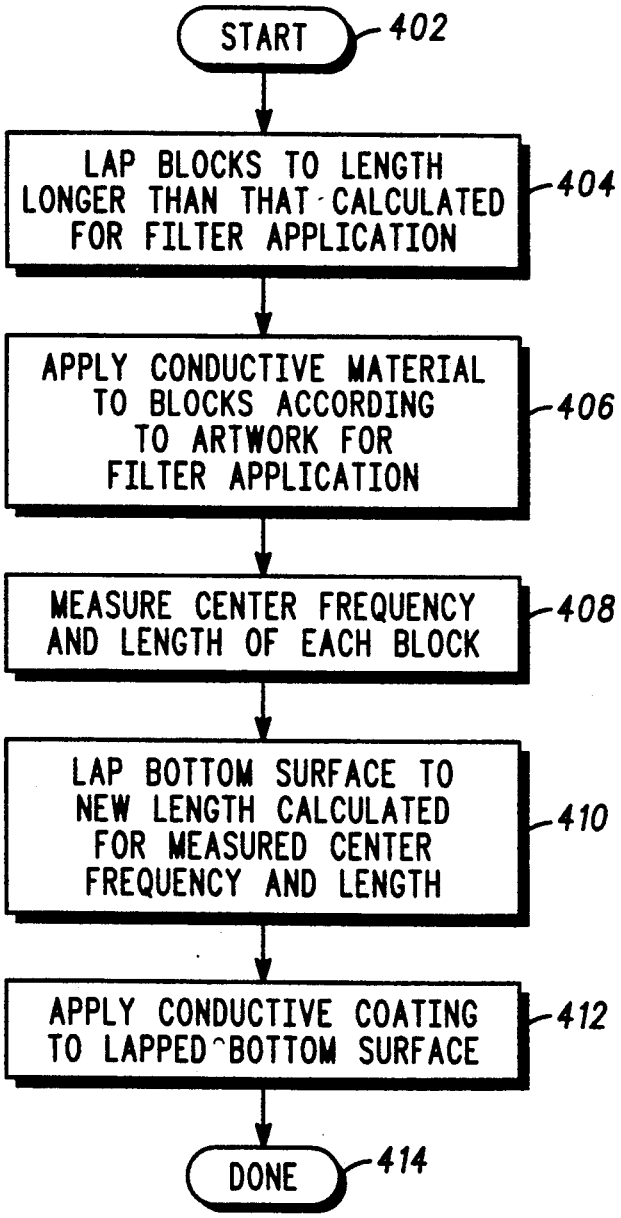
FIG. 4 is a flow diagram of filter tuning and adjusting process, according to the present invention.

Referring next to FIG. 4, there is illustrated a flow diagram of filter tuning process, according to the present invention. Initially at START block 402, a batch of ceramic material is prepared and base dielectric blocks 210 are developed therefrom. The resonator length or height of base dielectric blocks 210 is selected to be intentionally longer than desired so that the resonator frequency is slightly lower than desired. The desired resonator length may be calculated using the dielectric constant for the batch of ceramic material. Next, at block 404, blocks 210 are lapped to a length that is longer than the calculated resonator length for producing the desired filter center frequency for a particular filter application.

Next, at block 406, lapped blocks 210 are plated with electrically conductive material using a predesigned artwork mask 310 which is designed to achieve the desired frequency related characteristics and other design specifications for a particular filter application. The artwork mask 310 for a particular filter 114 or 118 may be developed using conventional computer program modeling and mode-to-circuit translations, such as, for example, the program entitled "Super-Compact", available from Compact Software, Inc. The manner in which artwork mask 310 is used to apply the electrically conductive material to base dielectric block 210 may be accomplished using conventional means, such as, for example, a dry film imaging transfer system such as "RISTON" by Du Pont De Nemours & Co. (Inc.).

Next, at block 408, the center frequency and resonator length of the plated blocks 210 is measured. Then, at block 410, a new resonator length is calculated using the measured center frequency and resonator length, and plated blocks 210 are lapped to the new resonator length by removing plating and ceramic from the entire bottom surface of blocks 210. In paracticing the present invention, blocks 210 are measured and, depending on the number of millimeters of lapping required (eg. rounded to the nearest millimeter), placed into groups requiring the same amount of lapping. Next, at block 412, electrically conductive material is applied to the bottom surface of lapped blocks 210, and the tuning process is completed at block 414.

In summary, a novel multi-resonator ceramic filter has been described, wherein the resonators are tuned according to a predesigned artwork mask and thereafter adjusted in length to meet desired performance specifications. By utilizing the novel tuning process of the present invention, ceramic filters may be manufactured and tuned without the need for costly and unreliable etching or abrading the plated top surface thereof.

We claim:

1. A method manufacturing a filter with a predetermined center frequency, said method comprising the steps of:

producing dielectric means comprised of a dielectric material having top, side and bottom surfaces, said dielectric means further having at least two holes extending from the top surface toward the bottom surface thereof and spatially disposed at a predetermined distance from one another, the side and bottom surfaces of said dielectric means selectively covered with a conductive material to provide a transmission line resonator for each of said at least two holes, and said at least two holes having a length that is greater than a predetermined length producing the predetermined center frequency, and said dielectric means having at least two measurable frequency related characteristics;

producing an artwork mask for adjusting the frequency related characteristics of the dielectric means;

applying conductive material to the top surface of said dielectric means in accordance with the artwork mask;

measuring one of the frequency related characteristic of said dielectric means to obtain a measurement;

removing the conductive material and a layer of the dielectric material from the bottom surface, said layer having a thickness related to the measurement; and applying conductive material to the bottom surface of said dielectric means.

2. A method, according to claim 1, wherein the step of measuring the pre-selected frequency related characteristic includes the step of measuring the center frequency of said dielectric means.

3. A method, according to claim 1, wherein the step of producing said dielectric means includes the step of plating the surfaces of said at least two holes.

4. A method, according to claim 1, wherein the steps of measuring the selected frequency related characteristic includes the step of measuring the length of said at least two holes.

5. A method, according to claim 1, wherein the step of measuring the selected frequency related characteristic includes the step of measuring the center frequency of said dielectric means and the length of said at least two holes.

6. A filter having a predetermined center frequency, comprising:

dielectric means comprised of a ceramic material having top side, and bottom surfaces, said dielectric means further having at least two holes extending from the top surface toward the bottom surface thereof and spatially disposed at a predetermined distance from one another, the side and bottom surfaces of said dielectric means selectively covered with a conductive material to provide a transmission line resonator for each of said at least two holes, and further having at least two measurable frequency related characteristics;

conductive plating means comprised of a conductive material and disposed on the top surface of said dielectric means, said conductive plating means having an arrangement of conductive material in accordance with an artwork mask for adjusting the frequency related characteristics of said dielectric means; and the bottom surface of said dielectric means having been lapped over its entire surface to remove an amount of the ceramic material based at least in part upon a measurement of one of the frequency related characteristics of said dielectric means, and thereafter having been recovered by a conductive material.

7. A duplexer for use in a radio frequency (RF) transceiver having an antenna for RF communications, comprising:

a first filter coupled between the RF transceiver and antenna for selectively passing a range of desired transmission frequencies; and a second filter coupled between the RF transceiver and antenna for selectively passing a range of desired reception frequencies, said second filter further including:

dielectric means comprised of a ceramic material having top side, and bottom surfaces, said dielectric means further having at least two holes extending from the top surface toward the bottom surface thereof and spatially disposed at a predetermined distance from one another, the side and bottom surfaces of said dielectric means selectively covered with a conductive material to provide a transmission line resonator for each of said at least two holes, and further having at least two measurable frequency related characteristics;

conductive plating means comprised of a conductive material and disposed on the top surface of said dielectric means, said conductive plating means having an arrangement of conductive material in accordance with an artwork mask for adjusting the frequency related characteristics of said dielectric means; and the bottom surface of said dielectric means having been lapped over its entire surface to remove an amount of the ceramic material based at least in part upon a measurement of one of the frequency related characteristics of said dielectric means, and thereafter having been recovered by a conductive material.

8. A duplexer for use in a radio frequency (RF) transceiver having an antenna for RF communications, comprising:

a first filter coupled between the RF transceiver and antenna for selectively passing a range of desired reception frequencies; and a second filter coupled between the RF transceiver and antenna for selectively passing a range of desired transmission frequencies, said second filter further including:

dielectric means comprised of a ceramic material having top side, and bottom surfaces, said dielectric means further having at least two holes extending from the top surface toward the bottom surface thereof and spatially disposed at a predetermined distance from one another, the side and bottom surfaces of said dielectric means selectively covered with a conductive material to provide a transmission line resonator for each of said at least two holes, and further having at least two measurable frequency related characteristics;

conductive plating means comprised of a conductive material and disposed on the top surface of said dielectric means, said conductive plating means having an arrangement of conductive material in accordance with an artwork mask for adjusting the frequency related characteristics of said dielectric means; and the bottom surface of said dielectric means having been lapped over its entire surface to remove an amount of the ceramic material based at least in part upon a measurement of one of the frequency related characteristics of said dielectric means, and thereafter having been recovered by a conductive material.

* * * * *